United States Patent [19]

Iwagaki et al.

[11] Patent Number: 4,840,870

[45] Date of Patent: Jun. 20, 1989

[54] HEAT-TRANSFER IMAGE-RECEIVING ELEMENT

[75] Inventors: Masaru Iwagaki, Hino; Toyoaki Masukawa, Hinode; Tawara Komamura, Hachioji; Wataru Ishikawa, Hachioji; Kimie Hoshino, Hachioji, all of Japan

[73] Assignee: Konishiroku Photo Industry Co., Ltd., Tokyo, Japan

[21] Appl. No.: 170,063

[22] Filed: Mar. 14, 1988

Related U.S. Application Data

[63] Continuation of Ser. No. 930,019, Nov. 7, 1986, abandoned, which is a continuation of Ser. No. 679,912, Dec. 10, 1984, abandoned.

[30] Foreign Application Priority Data

Dec. 19, 1983 [JP] Japan ..... 58-237965

[51] Int. Cl.[4] ..... G03C 5/54

[52] U.S. Cl. ..... 430/201; 430/200; 430/203; 430/213; 430/216; 430/220; 430/931

[58] Field of Search ..... 430/203, 200, 213, 216, 430/220, 351, 372, 551, 512, 931, 201

[56] References Cited

U.S. PATENT DOCUMENTS

| | | | |
|---|---|---|---|
| 3,253,921 | 5/1966 | Sawdey | 430/931 |
| 3,709,690 | 1/1973 | Cohen et al. | 430/213 |
| 3,764,337 | 10/1973 | Arai et al. | 430/551 |
| 4,121,939 | 10/1978 | Adachi et al. | 430/216 |
| 4,155,765 | 5/1979 | Fujiwhara et al. | 430/372 |
| 4,159,910 | 7/1979 | Fujiwhara et al. | 430/372 |
| 4,254,216 | 3/1981 | Uchida et al. | 430/372 |
| 4,323,633 | 4/1982 | Beretta | 430/931 |
| 4,396,698 | 8/1983 | Karino et al. . | |
| 4,463,079 | 7/1984 | Naito et al. | 430/203 |
| 4,478,927 | 10/1984 | Naito et al. | 430/203 |

FOREIGN PATENT DOCUMENTS

| | | |
|---|---|---|
| 48537 | 4/1979 | Japan . |
| 2076984 | 12/1981 | United Kingdom . |

*Primary Examiner*—Richard L. Schilling

*Attorney, Agent, or Firm*—Frishauf, Holtz, Goodman & Woodward

[57] ABSTRACT

In a heat-transfer image-receiving element adapted to have a superposed relation, at least during a heat-transfer processing, with a heat-transfer element containing a heat-transferable dye donator, wherein said heat-transfer image-receiving element comprises at least one of compounds having the following general Formula (I), (II) or (III) and at least one of compounds having the following general Formula (IV)

Formula (I)

Formula (II)

Formula (III)

Formula (IV)

wherein $R_1$, $R_1'$, $R_3$, $R_3'$ and $R_5$ each is a hydrogen atom, alkyl, alkenyl, cycloalkyl, phenyl, naphthyl, heterocyclic, acyl, alkylsulfonyl, arylsulfonyl or aralkylsulfonyl group; $R_2$, $R_4$, $R_4'$, $R_6$ and $R_7$ each is a hydrogen atom, a halogen atom, or a monovalent organic group, l is an integer of from 1 to 4, q is an integer of from 1 to 6, m, n and p each is an integer of from 1 to 3, provided if the l, m, n, p and q each is an integer of not less than 2, the $R_2$, $R_4$, $R_4'$, $R_6$ and $R_7$ are allowed to be either the same as or different from one another; $R_8$, $R_9$ and $R_{10}$ each is a hydrogen atom, a halogen atom, alkyl, alkenyl, cycloalkyl, phenyl, naphthyl, heterocyclic, acyl, amino, alkylsulfonyl, arylsulfonyl or aralkylsulfonyl group, and a, b and c each is an integer of from 1 to 4, $R_8$, $R_9$ and $R_{10}$ are allowed to be either the same as or different from one another. The heat-transfer image receiving element renders a dye image formed in the color heat-diffusion transfer process stable particularly under a light irradiation condition and excellent in stability against discoloration by light and heat.

11 Claims, No Drawings

HEAT-TRANSFER IMAGE-RECEIVING ELEMENT

This application is a continuation of application Ser. No. 930,019, filed Nov. 7, 1986, now abandoned; which is a continuation of Ser. No. 679,912 filed Dec. 10, 1984 (abandoned).

BACKGROUND OF THE INVENTION

1. Field of the Invention

The present invention relates to a heat-transfer image-receiving element, and more particularly to an image-receiving element used in combination with the heat-developable color light-sensitive element of a heat-developable photographic light-sensitive material or an image-receiving element used in combination with the color heat-sensitive element of a heat-sensitive transfer material, the heat-transfer image-receiving element being capable of keeping the formed color dye image thereon rigid against light and heat. In addition, the present invention relates to an image-receiving element used in combination with a heat-transfer element, wherein the heat-transfer element may be either the light-sensitive element of a heat-developable photographic material or the heat-sensitive element of a heat-sensitive transfer material.

2. Description of the Prior Art

Methods for obtaining a color image by a dry/heat development process has many advantages in the processing period of time, anxiety about pollution, and cost over the conventional wet processes. The method using the dry/heat process is broadly classified into two types; one is of those techniques using heat-developable photographic materials and the other of those techniques using heat-sensitive transfer materials. The heat-developable photographic material is composed fundamentally of a light-sensitive element and an image-receiving element. The light-sensitive element comprises fundamentally a support coated thereon with light-sensitive layers and other photographic component layers, the light-sensitive layers each containing an organic salt, developing agent (reducing agent), heat-transferrable dye donator (including a dye precursor), and, if necessary, light-sensitive silver halide, binder, and additives. And the image-receiving element comprises an image-receiving layer capable of forming a dye image by the heat-diffusion transfer of the heat-transferrable dye released or formed by heat development from the heat-transferrable dye donator contained in the above light-sensitive element, and may, if necessary, have a support.

On the other hand, the heat-sensitive transfer material is composed fundamentally of a heat-sensitive element and an image-receiving element. The heat-sensitive element comprises fundamentally a support coated thereon with heat-sensitive ink layers and other component layers, the heat-sensitive ink layer containing a sublimable, volatile or fusible heat-transferable dye donator. And the image-receiving element comprises an image-receiving layer capable of forming a dye image by the heat-diffusion transfer of the heat-transferable dye released or formed by heating from the heat-transferable dye donator contained in the above heat-sensitive element, and may, if necessary, have a support.

The heat-transfer element and the image-receiving element of the heat-transfer material in these heat-diffusion transfer processes should have at least a superposed relation at the time of heat transfer; both elements may be either in advance integrated into one unit or superposed only at the time of heat transfer, and may also be either of the type of being peeled apart after completion of the heat transfer or of the non-peel-apart type; these may be used properly according to purposes for which the heat-transfer material is used.

The dye of a dye image formed on an image-receiving element by the above-described technique which utilizes the heat diffusion, when exposed to light during its storage, is under an atmosphere where the dye is very liable to react with oxygen or a very small amount of a heavy metal that is usually present in the image-receiving element. Because of this, there has been a large disadvantage that the expected dye is oxidized to become a different compound, causing color stain trouble or deterioration of the formed color density.

The former technique, however, has the problem that the technique has no adequate antidiscoloration effect to light and, on the contrary, can accelerate discoloration, and also, particularly in the case of a reduction-discoloration-type dye, sometimes accelerates discoloration by heat (dark discoloration). The latter technique has the problem that a proper antidiscoloration effect requires the use of a large amount of an ultraviolet absorbing agent, but still no satisfactory effect can be expected.

OBJECT OF THE INVENTION

As a result of our investigation to solve the above-mentioned problems, we have found an improved heat-transfer image-receiving element.

It is therefore an object of the present invention to provide an image-receiving element which is capable of rendering a dye image formed in the color heat-diffusion transfer process present stable therein particularly under a light irradiation condition, and which is excellent in the antidiscoloration effect to light.

CONSTRUCTION OF THE INVENTION

The above object of the present invention is accomplished by the following image-receiving element: in a heat-transfer image-receiving element which, at least while heat transfer takes place, has a superposed relation with a heat-transfer element containing a heat-transferable dye donator, the heat-transfer image-receiving element which contains at least one of those compounds having the following Formulas (I), (II) and (III) and at least one of those compounds having the following Formula (IV).

Formula (I)

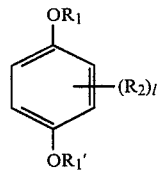

Formula (II)

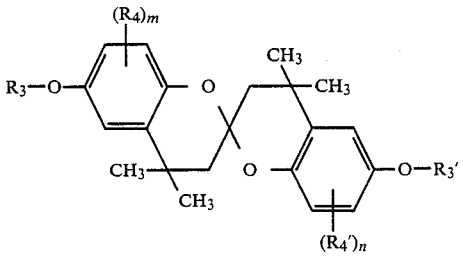

-continued

Formula (III)

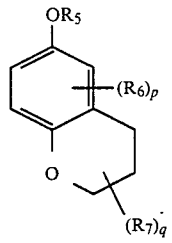

Formula (IV)

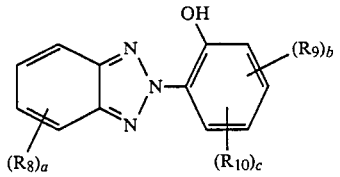

wherein $R_1$, $R_1'$, $R_3$, $R_3'$ and $R_5$ each is hydrogen, an aliphatic group, aromatic group, heterocyclic group, acyl group, alkylsulfonyl group, arylsulfonyl group or aralkylsulfonyl group, and is preferably hydrogen or an alkyl group having from 1 to 20 carbon atoms; $R_2$, $R_4$, $R_4'$, $R_6$ and $R_7$ each is hydrogen, a halogen or a monovalent organic group, and is preferably hydrogen or an alkyl group having from 1 t 20 carbon atoms; l is an integer of from 1 to 4; q is an integer of from 1 to 6 and is preferably from 1 to 4; and m, n and p each is an integer of from 1 to 3, provided, if the l, m, n, p and q each is an integer of not less than 2, the $R_2$, $R_4$, $R_4'$, $R_6$ and $R_7$ may be either the same as or different from one another, and may further form a ring.

To be more concrete, those aliphatic groups represented by the $R_1$, $R_1'$, $R_3$, $R_3'$ and $R_5$ include alkyl, alkenyl, cycloalkyl, and the like groups, the alkyl being of a straight or branched chain having preferably from 1 to 20 carbon atoms, the alkenyl being of a straight or branched chain having preferably from 2 to 20 carbon atoms, the cycloalkyl being of preferably a 5- to 7-membr cyclic ring.

Those aromatic groups represented by the $R_1$, $R_1'$, $R_3$, $R_3'$ and $R_5$ include phenyl and naphthyl groups, and those heterocyclic groups are nitrogen-, oxygen- or sulfur-containing 5- or 6-member cyclic groups including, e.g., furyl, pyranyl, tetrahydropyranyl, imidazolyl, pyrrolyl, pyrimidyl, pyradinyl, triazinyl, thienyl, quinolyl, oxazolyl, pyridyl, and the like.

Those acyl groups represented by the $R_1$, $R_1'$, $R_3$, $R_3'$ and $R_5$ include alkylcarbonyl and arylcarbonyl groups having an alkyl group having from 1 to 20 carbon atoms, such as, e.g., acetyl, pivaloyl, oleyl, lauroyl, benzoyl, and the like. Those alkylsulfonyl, arylsulfonyl and aralkylsulfonyl groups represented by the $R_1$, $R_1'$, $R_3$, $R_3'$ and $R_5$ include, e.g., methanesulfonyl, butanesulfonyl, benzenesulfonyl, toluene-sulfonyl, benzylsulfonyl, and the like.

Those monovalent organic grous represented by the foregoing $R_2$, $R_4$, $R_4'$, $R_6$ and $R_7$ are ones substitutable to the benzene ring of Formula (I), (II) or (III), including, e.g., alkyl, alkyloxy, alkylthio, phenyl, phenoxy, acyl, acylamino, sulfonamido, alkylamino, alkoxycarbonyl, and the like groups, which all have from 1 to 20 carbon atoms.

In Formula (IV), $R_8$, $R_9$ and $R_{10}$ each represents hydrogen, a halogen, a hydroxy, an aliphatic, aromatic, heterocyclic, acyl, amino, alkylsulfonyl, arylsulfonyl or aralkylsulfonyl group, and inter alia, hydrogen, an alkyl group having from 1 to 20 carbon atoms, or a halogen is preferred; and a, b and c each is an integer of from 1 to 4, provided that the relation thereof is $b+c \leqq 4$. In addition, when a, b and c each is an integer of not less than 2, the $R_8$, $R_9$ and $R_{10}$ may be either the same as or different from one another. To be more concrete, those aliphatic, aromatic, heterocyclic, acyl and sulfonyl groups represented by the $R_8$, $R_9$ and $R_{10}$ are as defined in the foregoing $R_1$, $R_1'$, $R_3$, $R_3'$ and $R_5$, and those amino groups represented by the same include mono- or dialkylamino groups (e.g., N-ethylamino, N-t-octylamino, N,N-diethylamino, N,N-di-t-butylamino, etc.), and acylamino groups (e.g., acetamino, benzoylamino, etc.).

The following are examples of those compounds having Formula (I), (II) or (III), which are usable in the present invention, but the usable compounds of the invention are not limited thereto.

Examples of Compound A of the Invention (I)-1

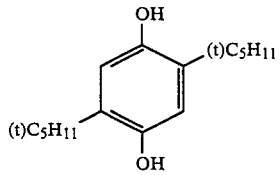

(I)-2

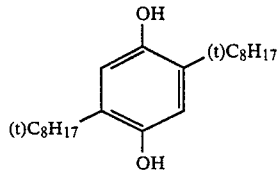

(I)-3

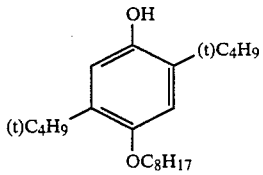

(I)-4

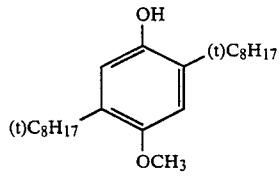

(I)-5

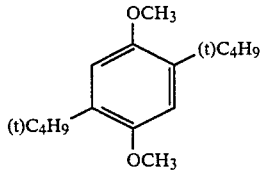

(I)-6

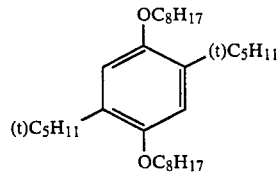

-continued
Examples of Compound A of the Invention
(I)-7
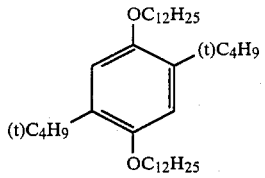
(II)-1
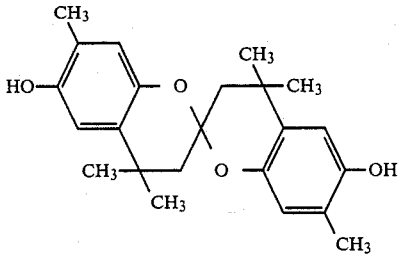
(II)-2
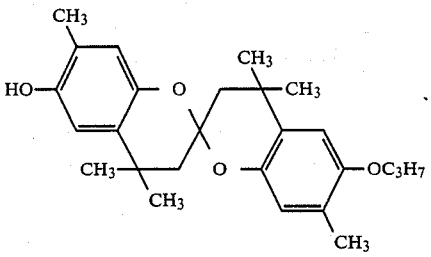
(II)-3
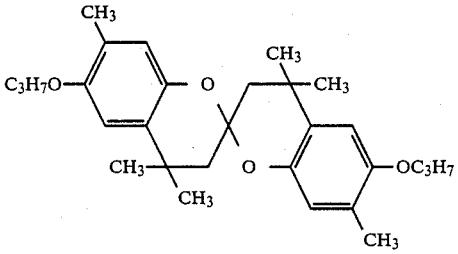
(II)-4
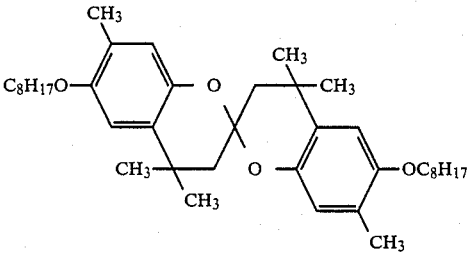
(II)-5
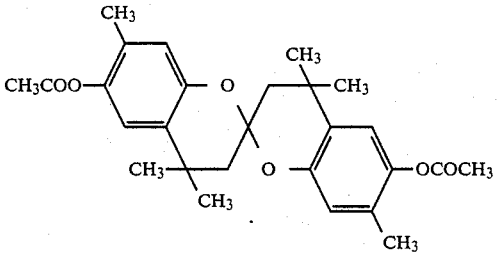
-continued
Examples of Compound A of the Invention
(III)-1
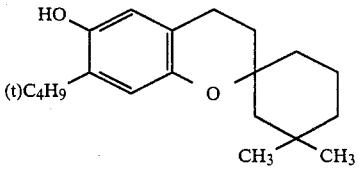
(III)-2
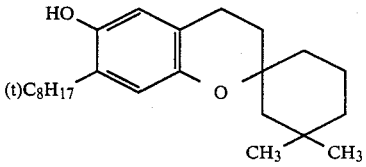
(III)-3
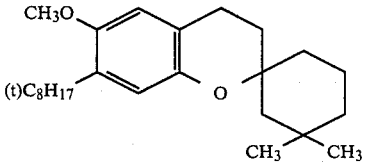
(III)-4
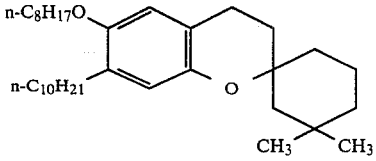
(III)-5
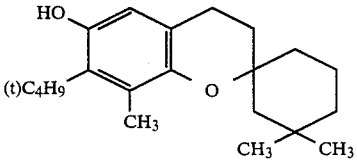
(III)-6
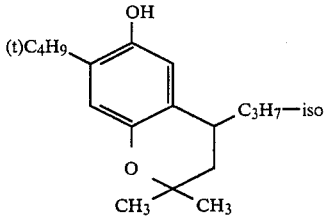
(III)-7
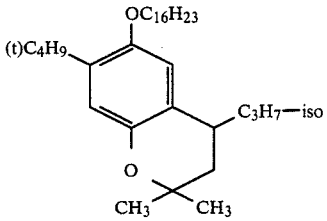
(III)-8
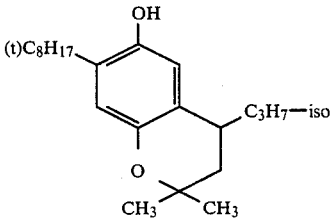

-continued

Examples of Compound A of the Invention (III)-9

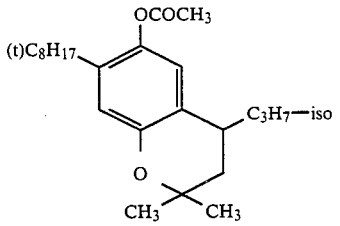

III-10

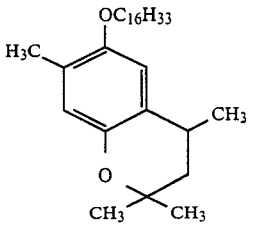

These compounds A of the invention may be synthesized by any of those methods described in, e.g., U.S. Pat. Nos. 4,155,765, 4,159,910, and 4,314,011.

These compounds may be used alone or in combination of two or more of them.

The use quantity of any of these compounds, although not limitative, is from 10 to 1000 mole%, and preferably from 10 to 100 mole% per mole of the maximum-density image dye.

The term, a "maximum density", used herein is a density obtained by that diffusion dyes formed in or released from a heat-transfer element are transferred to a heat-transfer image receiving element. Whereby, a reflection density of from 2.0 to 4.0 can be produced onto an image receiving element in the case of using the dyes having an ordinary molecular extinction coefficient of from 5,000 to 100,000.

Therefore, the amount of dyes for obtaining a maximum density of either one of yellow, magenta and cyan is from $1.0\times10^{-4}$ mol/m$^2$ to $4.0\times10^{-3}$ mol/m$^2$, and when producing a color image with yellow, magenta and cyan dyes, a maximum density of the color image is the aggregate of each maximum density of the yellow, magenta and cyan dyes, so that the amount of dyes in this case is from $3.0\times10^{-4}$ to $1.2\times10^{-2}$ mol/m$^2$.

The following are examples of those compounds having the foregoing Formula (IV) (hereinafter called Compound B), but the Compounds B are not limited thereto.

Examples of Compound B of the Invention (IV)-1

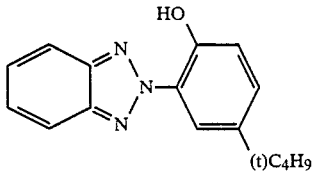

(IV)-2

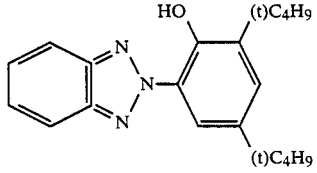

-continued

Examples of Compound B of the Invention (IV)-3

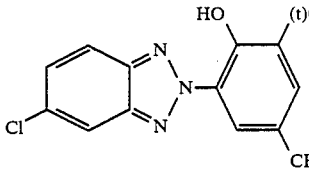

(IV)-4

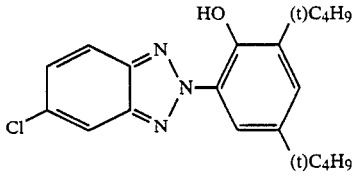

(IV)-5

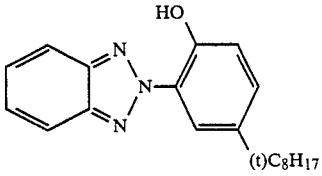

(IV)-6

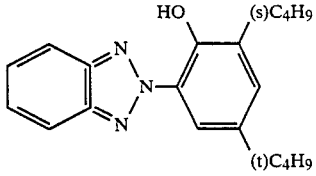

(IV)-7

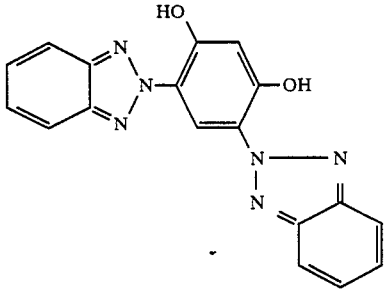

(IV)-8

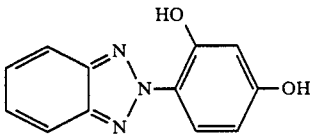

(IV)-9

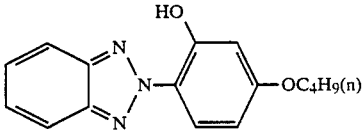

(IV)-10

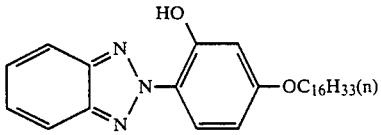

(IV)-11

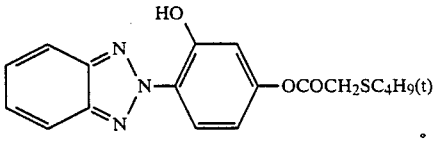

-continued

Examples of Compound B of the Invention (IV)-12

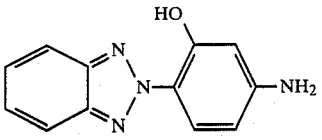

(IV)-13

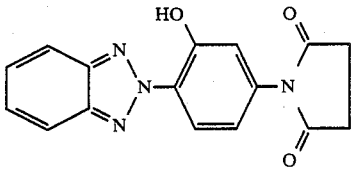

(IV)-14

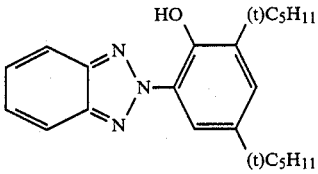

(IV)-15

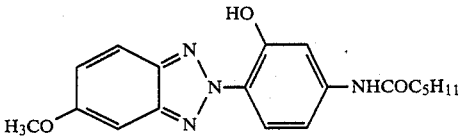

(IV)-16

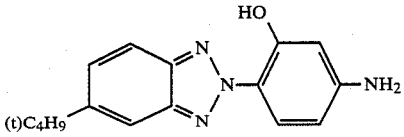

(IV)-17

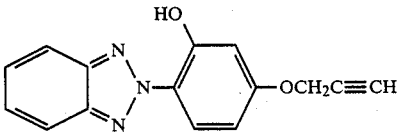

(IV)-18

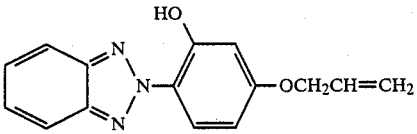

(IV)-19

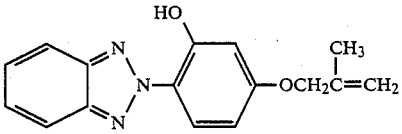

(IV)-20

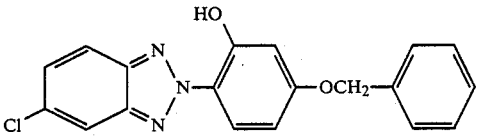

(IV)-21

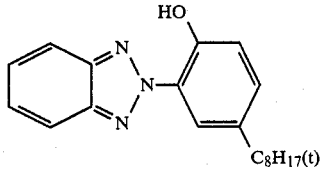

-continued

Examples of Compound B of the Invention (IV)-22

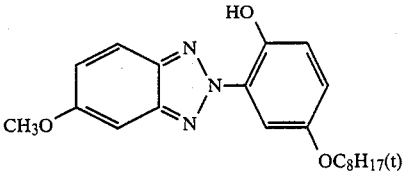

(IV)-23

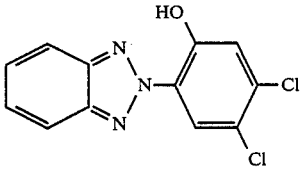

(IV)-24

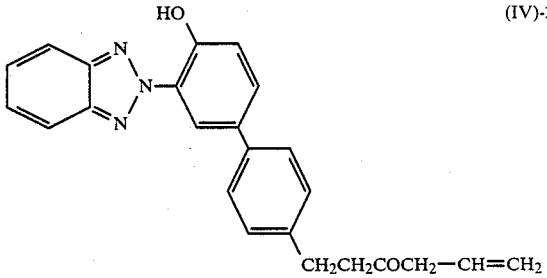

(IV)-25

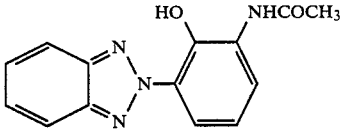

(IV)-26

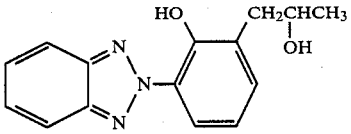

(IV)-27

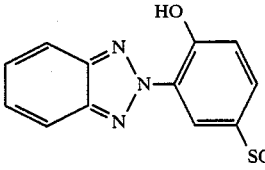

These compounds B as enumerated above are described in, e.g., U.S. Pat. Nos. 3,754,919 and 4,220,711.

These Compounds B of this invention may be used alone or in combination of two or more of them. The using quantity of any of Compounds B, although not limitative, is from 1 to 1000 mole%, and preferably from 5 to 100 mole% per mole of the maximum-density image dye. The term, "maximum density" has the same meaning as aforementioned.

In the present invention, the combined use of at least one of Compounds A with at least one of Compounds B prevents the heat-transferred dye effectively not only from the discoloration by light but also from dark discoloration. That is, the incorporation of Compound A or B prevents both light discoloration-accelerating and dark discoloration-accelerating effects which are considered due to the side reaction of Compound B or A, and further, Compound A, in the presence of Compound B, improves largely the inadequate light discoloration-preventing effect by the Compound B.

No restrictions are put on how to incorporate Compounds A and B of this invention into the image-receiving element. In the case where the image-receiving element comprises at least a support and an image-receiving layer, Compounds A and B are added to the surface and/or the inside of the image-receiving layer. Compounds A and B of this invention, when added to the surface, are coated in the form of a dispersion liquid, and, when added to the inside, are added to an image-receiving layer-coating liquid before the formation of an image-receiving layer, or, after the formation of an image-receiving layer, are impregnated into the layer by immersing the layer in a liquid containing the compounds. Also where the image-receiving element is of the type of functioning as both support and image-receiving layer, the addition of the compounds may be made in like manner.

Where the image-receiving element has a support, the support is desirable to be of a heat-resistant material that withstands heat-transfer processing, such as, e.g., glass, metal, ceramics, paper, photographic baryta paper, ivory paper, art paper, condenser paper, polycarbonate film, polyester-sulfone film, polyimide film, cellulose-ester film, acetyl-cellulose film, polyvinyl-acetal film, polyethylene-terephthalate film, or the like.

Materials as the image-receiving element usable in this invention include paper and synthetic high-molecular materials (film). The high-molecular materials (film) include, e.g., polyacrylonitrile, acrylonitrile-styrene copolymer, acrylonitrile-butadiene-styrene copolymer, polyacetals, polyether chloride, polyvinylidene chloride, polyvinyl chloride, polyvinyl carbazole, polystyrene, styrene-butadiene copolymer, polycellulose acetates, polyvinyl acetals (such as polyvinyl butyral, polyvinyl formal), polytetrafluoroethylene, polychlorotrifluoroethylene, polyethylene, chlorinated polyethylene, polycarbonate, polyvinyl acetate, polyvinyl alcohol, polypropylene, polyvinyl pyrolidone, polymethacrylates (such as polymethyl methacrylate, polyethyl methacrylate, polypropyl methacrylate, polyisopropyl methacrylate, poly-t-butyl methacrylate, polycyclohexyl methacrylate, polyethylene-glycol dimethacrylate, poly-2-cyanoethyl dimethacrylate, etc.), polyesters (such as polyethylene terephthalate), polyamides, polyimides, polysulfones, and the like. These synthetic high-molecular materials may be used alone or in a mixture, or may also be used in a copolymer.

Among these, the preferred materials as the image-receiving element include the polyvinylidene chloride, polyvinyl chloride, polycarbonates, polyethylene terephthalate; polycellulose acetates such as triacetate, diacetate; polyamides such as those synthesized from heptamethylenediamine and terephthalic acid, fluorenedipropylamine and adipic acid, hexamethylenediamine and diphenic acid, and hexamethylenediamine and isophthalic acid; and such a material principally comprising at least one compound selected from a group consisting of polyesters such as those synthesized from diethylene glycol and diphenylcarboxylic acid, and ethylene glycol and bis-p-carboxyphenoxybutane.

The particularly preferred materials as the image-receiving element are vinyl chloride polymers and polycarbonates.

The vinyl chloride polymer usable in this invention is a polymer obtained by the suspension polymerization, block polymerization, emulsion polymerization, homogeneous-solution polymerization, deposition-solution polymerization, or the like, of vinyl chloride with the irradiation of light or rays or in the presence of a free-radical-polymerization catalyst such as a peroxide. The polymer of this invention may be polyvinyl chloride that is a single polymer of polyvinyl chloride, and, if containing not less than 50 mole% vinyl chloride, may also be a copolymer with any of other monomers which include unsaturated aliphatic acid alkyl esters such as vinyl acetate, vinyl propionate, coconut acid vinyl ester, beef tallow acid vinyl ester, etc.; acrylic or methacrylic acid and the alkyl esters thereof such as acrylic acid, methacrylic acid, methyl methacrylate, ethyl methacrylate, butyl acrylate, 2-hydroxyethyl methacrylate, 2-ethylhexyl acrylate, etc.; maleic acid and the alkyl esters thereof such as maleic acid, diethyl maleate, dibutyl maleate, dioctyl maleate, etc.; alkyl-vinyl ethers such as methyl-vinyl ether, 2-ethylhexyl-vinyl ether, lauryl-vinyl ether, palmityl-vinyl ether, stearyl-vinyl ether, etc.; and, further, vinylidene chloride, ethylene, propylene, acrylonitrile, methacrylonitrile, styrene, chlorostyrene, itaconic acid and the alkyl esters thereof, crotonic acid and the alkyl esters thereof, polyhalogenated olefins such as dichloroethylene, trifluoroethylene, etc., cycloolefins such as cyclopentene, etc., aconitic acid esters, vinyl benzoate, benzoyl-vinyl ether, and the like. The polymerization degree of vinyl chloride polymers is standardized to be from 275 to 2,460 in the JIS standard JIS K 6721, but in the present invention, both single polymers and copolymers may be used regardless of the polymerization degree range specified in the JIS standard.

The polycarbonate used in the present invention covers the polyesters produced from carbonic acid and glycols or dihydric phenols. The glycols or dihydric phenols suitably usable in this invention include p-xylylene glycol, 2,2-bis(4-oxyphenyl)propane, bis(4-oxyphenyl)methane, 1,1-bis(4-oxyphenyl)ethane, 1,1-bis(4-oxyphenyl)butane, 1,1-bis(4-oxyphenyl)isobutane, 1,1-bis(4-oxyphenyl)cyclohexane, 2,2-bis(4-oxyphenyl)-butane, and the like.

To the vinyl chloride polymer or polycarbonate as the particularly preferred image-receiving element of this invention may be added a plasticizer. The plasticizer includes phthalic acid esters (such as dimethyl phthalate, dibutyl phthalate, dioctyl phthalate, didecyl phthalate, etc.), adipic acid esters (such as dioctyl adipate, methyl-lauryl adipate, di-2-ethyl-hexyl adipate, ethyl-lauryl adipate, etc.), oleic acid esters, succinic acid esters, maleic acid esters, sebacic acid esters, citric acid esters, epoxystearic acid esters, and further, phosphoric acid esters such as triphenyl phosphate, tricresyl phosphate, etc., glycol esters such as ethylphthalylethyl glycolate, butylphthalylbutyl glycolate, and the like.

The image-receiving element of the present invention may be applied as the image-receiving element of those heat-development-type photographic materials or heat-diffusion transfer processes as disclosed in, e.g., Japanese Patent Application Nos. 122596/1982 and 205447/1982; Japanese Patent O.P.I. Publication Nos. 186744/1982, 179840/1982, 198458/1982 and 207250/1982; Japanese Patent Application Nos. 229649/1982, 229650/1982, 229675/1982, 229671/1982, 179236/1982, 33363/1983, 33364/1983 and 34083/1983; Japanese Patent O.P.I. Publication Nos. 40551/1983, 58543/1983, 79247/1983 and 149047/1983. That is, the heat-transferable dye released or formed by the heat development of the photographic material after being subjected to light information is transferred onto the image-receiving element of this invention. General technologies relating to heat-development elements and heat-development-type photographic materials are of the prior art. The image-receiving element of the present invention may be used in combination with any type of these prior-art heat-development elements.

Further, the image-receiving element of this invention may also be used as the heat-sensitive transfer image-receiving element of those heat-sensitive transfer recording media or heat-sensitive transfer recording processes are disclosed in Japanese Patent Application Nos. 217063/1982, 217796/1982, 217797/1982 and 229651/1982; and Japanese Patent O.P.I. Publication Nos. 15446/1976, 68253/1979 and 160691/1982. That is, for example, a heat-sensitive transfer ink sheet is superposed upon the image-receiving element of this invention, and the dye is thermally transferred imagewise according to thermal information by a thermal head, laser, xenon lamp, or the like, onto the image-receiving element of this invention. General technologies relating to heat-sensitive elements are of the prior art. The image-receiving element of this invention may be used in combination with any type of these heat-sensitive elements.

The term "heat transfer" used in this invention implies that the dye is diffused by its sublimation by heat (including vaporization not only without through a liquid state but through fusing from a solid state) or by a solvent, whereby the dye is transferred.

In addition, in the case where the image-receiving element of this invention is used with the heat-sensitive transfer material, it goes without saying that the element can be applied to (1) the image recording process, in which an image is recorded by developing a heat-sensitive element to form a color image by means of a heat source such as a thermal head comprising a printed resistor, thin film resistor, semiconductor resistor, etc., or a laser, xenon lamp, etc., and also to (2) the heat-sensitive transfer process, which uses a heat source that is controlled according to image information from a different system to thereby form an image on an image-receiving element, in which process the image dye is transferred by the heat source from a heat-sensitive element onto the image-receiving element.

The image-receiving element of this invention may contain various additives; e.g., inorganic additives such as titanium white, silica, talc, clay, barium sulfate, calcium carbonate, glass powder, kaolin, zinc oxide, and the like, for the purpose of providing mattness, whiteness, smoothness and gloss to the element.

The image-receiving element of this invention is capable of receiving the dye produced and transferred from a heat-transferable dye donator, and has at least a superposed relation with a heat-transfer element during the heat-diffusion transfer processing, and can be used in combination with any type of heat-transfer element as long as it contains a heat-transferable dye donator, the image-receiving and heat-transfer elements being allowed to be either of an integrated unit type or of a peel-apart type. The dye usable herein may be any of azo dyes, anthraquinone dyes, azomethine dyes, indoaniline dyes, naphthoquinone dyes, nitro dyes, styryl dyes, phthalo-cyanine dyes, quinophthalonetriphenylmethane dyes, cyanine dyes, or the like, but the remarkably effective ones among these are the azomethine and indoaniline dyes.

The azomethine dyes are those having in the molecules thereof a color-forming group of the following linkage:

$$>C{=}N-,$$

and, in general, are formed by the reaction of active methylene group-having compounds with aromatic primary amines.

Particularly, the oxidation coupling reaction product from an open-chain active methylene compound with a p-phenylenediamine derivative is an yellow dye, while that from a 1-phenyl-5-pyrazolone derivative is a magenta dye.

The indoaniline dye includes N-(p-aminophenol)-p-quinoneimine and the derivatives thereof, which are usually synthesized by the condensation reaction of p-nitrosophenol or quinonechloroimine with a dialkylaniline by the reaction of a nitroso- or nitrodialkylaniline with phenol or naphthol in the presence of a reducing agent in an alkaline solution; or by the oxidation coupling reaction of a p-phenylenediamine derivative with phenol or naphthol.

There are various known types of the heat-transferable dye donator, which denate (release or form) heat-transferable dyes during heat development or heat-sensitive transfer, but the heat-transfer element usable in combination with the image-receiving element of this invention may be one containing a heat-transferable dye donator of any type. The present invention may be applied to any of the following materials or processes; for example, those heat-development-type photographic materials containing photographic couplers and a color-developing agent as disclosed in U.S. Pat. Nos. 3,531,286, 3,761,270 and 3,764,328; Research Disclosure Nos. 15108, 15127, 12044 and 16479; and the like; those using leuco dyes as disclosed in U.S. Pat. No. 3,180,731 and Research Disclosure Nos. 13443 and 14347; those utilizing the silver-dye bleach process as disclosed in U.S. Pat. No. 4,235,957 and Research Disclosure Nos. 14433, 14448, 15227, 15776, 18137 and 19419; and those heat-bleach processes for heat-development-type light-sensitive materials as disclosed in U.S. Pat. Nos. 4,124,398, 4,124,387 and 4,123,273.

Where the heat-transfer element to be combined with the image-receiving element of this invention is a heat-development-type light-sensitive material, a developing agent (reducing agent), without being incorporated into the light-sensitive element in accordance with the conventionally known construction, may be incorporated, for example, into the image-receiving element of this invention. The light-sensitive element may have photographic layers such as a light-sensitive layer containing an organic silver salt, developing agent (reducing agent), dye donator, binder, silver halide, additives (such as color-toning agent, development controlling agent, chemical sensitizer, spectral sensitizer, antifoggant, filter dye, antihalation dye, dye releasing aid, etc.), and interlayer, protective layer, subbing layer, barrier layer, and the like. And where the present invention is applied to the heat-development-type photographic material, the material may have a reflective layer.

On the other hand, also in the case where the heat-transfer element to be combined with the image-receiving element of this invention is a heat-sensitive element, the heat-sensitive element may contain various additives.

The image-receiving element of this invention may, as earlier mentioned, consist of an image-receiving layer alone to be coated or superposed upon the heat-transfer element, or may be of the construction comprising an image-receiving layer and a support.

EXAMPLES

Example 1

On a subbed 20 μm-thick transparent polyethylene terephthalate film support was coated a 0.8 g/m$^2$ of water-soluble polyvinyl butyral (polymerization degree 650, average molecular weight 33000, butylation degree 9 mole%, acetylation degree 12 mole%) layer, into which layer was incorporated $8.0\times10^{-4}$ mole/m$^2$ of each of the following dyes (1) to (3), whereby Heat-Transfer Element Samples (a) to (c) were prepared.

On the other hand, on an art paper support was coated a polyvinyl chloride (#354, a product of General Science Corp.) solution containing tetrahydrofuran so that its thickness is 7 μm, whereby Image-Receiving Element A (for comparison) was prepared. Further, to the polyvinyl chloride layer of Image-Receiving Element A was added 0.7 g/m$^2$ of Compound (I)-6 alone of this invention to thereby prepare Image-Receiving Element B (for comparison); added 0.7 g/m$^2$ of Compound (IV)-14 alone of this invention to prepare Image-Receiving Element C (for comparison); and added 0.7 g/m$^2$ of each of both Compounds (I)-6 and (IV)-14 to thereby prepare Image-Receiving Element D (for this invention).

Heat-Transfer Element Samples (a) to (c) each was superposed on each of Image-Receiving Elements A to D to effect heat transfer by use of a thermal head with its applied voltage and pulse duration adjusted to thereby form a step-wedge pattern color image on the surface of each of the image-receiving elements.

Dye (1)

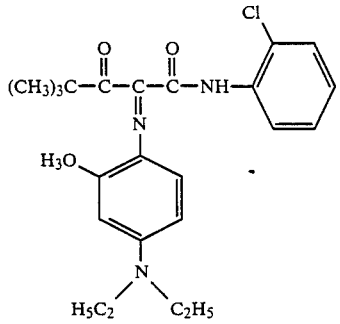

Dye (2)

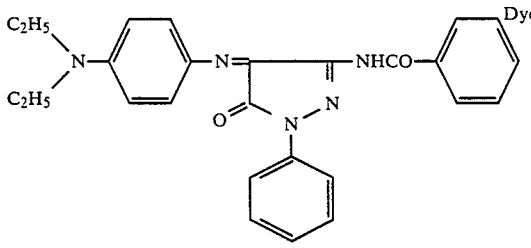

-continued

Dye (3)

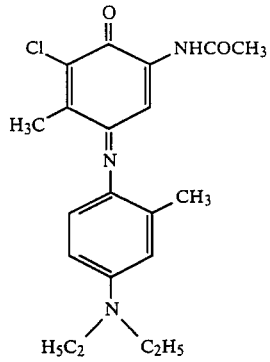

The color image formed on the surface of each of the image-receiving elements was subjected to a light-resistance test by means of a xenon arc fade-o-meter and heat- and moisture-resistance tests in a thermostatic incubator cabinet. The test results are as given in Tables 1 and 2, wherein each value is a dye residue percentage (%) (obtained when the original color density before the tests is regarded as 100).

TABLE 1

| Image-receiving element | Heat-transfer element (a) * Weak | (a) ** Strong | (b) Weak | (b) Strong | (c) Weak | (c) Strong |
|---|---|---|---|---|---|---|
| A (comparative) | 95 | 93 | 59 | 42 | 96 | 95 |
| B (comparative) | 83 | 74 | 86 | 76 | 80 | 74 |
| C (comparative) | 97 | 95 | 77 | 65 | 98 | 96 |
| D (invention) | 100 | 99 | 91 | 85 | 100 | 100 |

Note:
*Weak: Intensity of arc light $1.4\times10^{8}$ joule/m$^2$
**Strong: Intensity of arc light $2.8\times10^{8}$ joule/m$^2$

TABLE 2

| Image-receiving element | Heat-transfer element (a) *Heat | (a) **Moisture | (b) Heat | (b) Moisture | (c) Heat | (c) Moisture |
|---|---|---|---|---|---|---|
| A (comparative) | 90 | 84 | 93 | 94 | 90 | 88 |
| B (comparative) | 94 | 89 | 94 | 94 | 80 | 83 |
| C (comparative) | 91 | 86 | 90 | 92 | 84 | 86 |
| D (invention) | 94 | 90 | 96 | 95 | 93 | 90 |

Note:
*2400 hours at 77° C.
**2400 hours at 55° C./70% RH (relative humidity)

Example 2

In the Image-Receiving Elements A, B, C and D used in Example 1, in place of the polyvinyl chloride a 5%-by-weight plasticizer dibutyl phthalate-containing polycarbonate ("Panlite," a product of Teijin, Ltd.) was used to thereby prepare Image-Receiving Elements E, F, G and H. The prepared elements each was superposed upon the Heat-Transfer Element (b) of Example 1 to effect heat transfer in the same manner as in Example 1, and the samples each was then subjected to light-resistance tests in the same manner as in Example 1. The test results are as given in Table 3, wherein each value is dye residue percentage (%).

TABLE 3

| Image-receiving element | Heat-transfer element (b) Weak | Strong |
|---|---|---|
| E comparative) | 84 | 76 |
| F (comparative) | 93 | 88 |
| G (comparative) | 90 | 85 |
| H (invention) | 97 | 90 |

Example 3

One hundred and thirty milliliters of an aqueous dispersion liquid containing 3.1 g of 4-sulfobenzotriazole, 2 g of the following developing agent, 7.3 g of poly-4-vinyl-pyrolidone, 3.1 g of photographic gelatin, 5.2 g of pentaerythritol, 3 g of polyethylene glycol (#300), 2.6 g of the following dye donator compound, 75 mg of the following development accelerator, and hypo-sensitized silver bromide (silver 0.3 g) having an average particle size of 0.1 μm, after its pH was adjusted to 5.5, were coated on a subbed transparent polyethylene terephthalate film support so that its wet thickness is 52 μm, and then dried, whereby a heat-transfer element (heat-development-type light-sensitive material) was prepared.

Developing agent

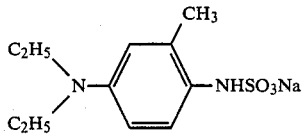

Dye donator compound

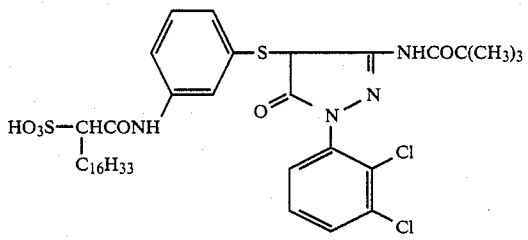

Development accelerator

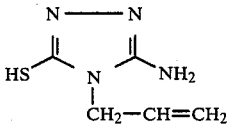

On the other hand, 460 ml of a tetrahydrofuran solution containing 40 g of polyvinyl chloride (n=1,100, a product of Wako Junyaku, K.K.), 5.2 g of Compound (II)-4 of this invention and 4.6 g of Compound (IV)-3 of this invention were coated on a photographic baryta paper-support, whereby an image-receiving element was prepared.

The foregoing heat-transfer element, after being subjected to 1000 C.M.S. exposure, was superposed on the above-prepared image-receiving element, and then subjected to one-minute heat development at 150° C. by use of Developer Module 277 (manufactured by 3M). The magenta color image formed on the image receiving element was subjected to light-resistance tests in the same manner as in Example 1. The obtained test results are:

Dye residue percentages:

94% at an intensity of xenon arc light of $1.4\times10^8$ joule/m$^2$

89% at an intensity of xenon arc light of $2.8\times10^8$ joule/m$^2$.

What is claimed is:

1. A heat transfer image forming method which comprises heating a heat-transfer image-receiving element in a superposed relation with a heat-transfer element containing a heat-transferable dye donator wherein dye is imagewise transferred by heat, said heat-transfer image-receiving element comprising (a) at least one compound having the following general Formula (I), (II) or (III) and (b) at least one compound having the following general Formula (IV)

Formula (I)

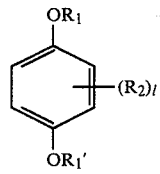

Formula (II)

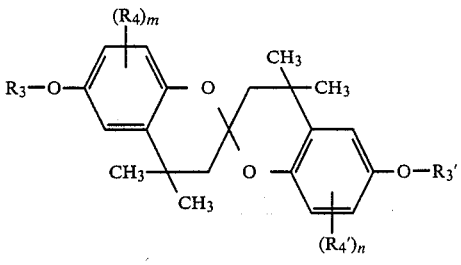

Formula (III)

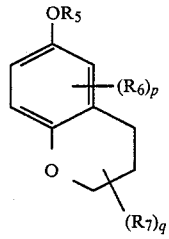

Formula (IV)

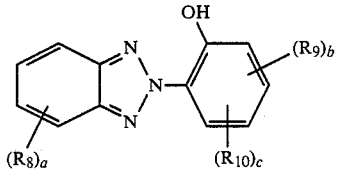

wherein $R_1$, $R_1'$, $R_3$, $R_3'$ and $R_5$ each is a hydrogen atom, alkyl, alkenyl, cycloalkyl, phenyl, naphthyl, heterocyclic, acyl, alkylsulfonyl, arylsulfonyl or aralkylsulfonyl group;

$R_2$, $R_4$, $R_4'$, $R_6$ and $R_7$ each is a hydrogen atom, a halogen atom, or a monovalent organic group, l is an integer of from 1 to 4, q is an integer of from 1 to 6, and m, n and p each is an integer of from 1 to 3, provided if the l, m, n, p and q each is an integer of not less that 2, $R_2$, $R_4$, $R_4'$, $R_6$ and $R_7$ are the same as or different from one another;

$R_8$, $R_9$ and $R_{10}$ each is a hydrogen atom, a halogen atom, alkyl, alkenyl, cycloalkyl, phenyl, naphthyl, heterocyclic, acyl, amino, alkylsulfonyl, arylsulfonyl or aralkylsulfonyl group, and a, b and c each is an integer of from 1 to 4, $R_8$, $R_9$ and $R_{10}$ are the same as or different from one another and c is an integer of from 1 to 4, $R_8$, $R_9$ and $R_{10}$ are allowed to be either the same as or different from one another.

2. The method of claim 1, wherein the content of the compound having the Formula (I), (II) or (III) in the image receiving element is from 10 to 1000 mol% per mol of an image dye rendering a maximum density.

3. The method of claim 2, wherein the content of the compound is from 10 to 100 mol% per mole of the image dye rendering a maximum density.

4. The method of claim 1, wherein the content of a compound having the Formula (IV) in the image receiving element is from 1 to 1000 mol% per mol of the image dye rendering a maximum density.

5. The method of claim 4, wherein the content of the compound is from 5 to 100 mol% per mol of the image dye rendering a maximum density.

6. The method of claim 1, wherein the image receiving element principally comprises at least one compound selected from the group consisting of polyvinylidene chloride; polyvinyl chloride; polycarbonate; polyethylene terephthalate; a polycellulose acetate a polyamide synthesized of heptamethylenediamine and terephthalic acid, fluorenedipropylamine and adipic acid, hexamethylenediamine and di-phenic acid, or hexamethylenediamine and isophthalic acid; and a polyester synthesized of diethylene glycol and diphenylcarboxylic acid, or ethylene glycol and bis-p-carboxyphenoxy butane.

7. The method of claim 6, wherein the compound is at least one compound selected from the group consisting of a vinyl chloride polymer and polycarbonate.

8. The method of claim 1, wherein the contents of the compound having one of the Formulas (I), (II) and (III) and the compound having the Formula (IV) each in the image receiving element are in the proportion from (1:9) to (9:1).

9. The method of claim 1, wherein the aggregate content of the compounds having the Formulas (I), (II), (III) and (IV) in the image receiving element is from 1.0 to 50% by weight to the weight of the image receiving element.

10. The method of claim 1, wherein $R_1$, $R_1'$, $R_3$, $R_3'$, and $R_5$ each is hydrogen or an alkyl grop having 1 to 20 carbon atoms; $R_2$, $R_4$, $R_4'$, $R_6$ and $R_7$ each is hydrogen or an alkyl group having from 1 to 20 carbon atoms; when compound (III) is present, q is an integer of from 1 to 4; $R_8$, $R_9$ and $R_{10}$ each is hydrogen, halogen or an alkyl group having from 1 to 20 carbon atoms.

11. The method of claim 1, wherein $b+c \leqq 4$.

* * * * *